US007198187B2

(12) United States Patent
Tsuritani

(10) Patent No.: US 7,198,187 B2
(45) Date of Patent: Apr. 3, 2007

(54) SPRING MANUFACTURING MACHINE

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 202 days.

(21) Appl. No.: 10/847,296

(22) Filed: May 18, 2004

(65) Prior Publication Data

US 2005/0023317 A1 Feb. 3, 2005

(30) Foreign Application Priority Data

Jul. 28, 2003 (JP) ..... 2003-280585

(51) Int. Cl.
*B65H 51/10* (2006.01)
*B21F 3/02* (2006.01)

(52) U.S. Cl. ..... 226/181; 226/124; 72/135

(58) Field of Classification Search ..... 226/168, 226/181, 124; 72/135, 145
See application file for complete search history.

(56) References Cited

U.S. PATENT DOCUMENTS 3,590,883 A * 7/1971 Kihs ..... 140/1
4,302,959 A * 12/1981 Yakovlev et al. ..... 72/138
4,571,973 A * 2/1986 Morita ..... 72/137
5,363,681 A * 11/1994 Speck et al. ..... 72/129
6,006,572 A * 12/1999 Tsuritani ..... 72/135
6,923,034 B2 * 8/2005 Matsuoka ..... 72/137

FOREIGN PATENT DOCUMENTS

| | | |
|---|---|---|
| JP | 2-56541 | 4/1990 |
| JP | 2000005962 | 1/2000 |
| JP | 2000061736 | 2/2000 |
| JP | 2002120034 | 4/2002 |
| JP | 2003-033839 | 2/2003 |
| JP | 2003-048030 | 2/2003 |

* cited by examiner

*Primary Examiner*—William A. Rivera
*Assistant Examiner*—Scott Haugland
(74) *Attorney, Agent, or Firm*—Rabin & Berdo, P.C.

(57) ABSTRACT

To improve a spring processing performance, a spring manufacturing machine is structured such that a rotating casing (26) is rotated around a common center line (C1), a final wire rod guide (17) is rotated around the common center line (C1), a wire rod feeding unit (12) is moved forward and backward by an actuating apparatus (53), and the actuating apparatus (53) is constituted by a motor (55) which has a reversible rotation shaft (56) with an axis directed to the lateral direction, an oscillating arm (57) which is oscillated forward and backward by the motor (55), a projection (58) which is provided in a free end of the oscillating arm (57) and opposes to the center line (C1) of a wire rod passage of a final wire rod guide (17), and an annular body (60) which has an annular groove (59) fitted to the projection (58) and is fitted to a hollow shaft (48).

2 Claims, 2 Drawing Sheets

SPRING MANUFACTURING MACHINE

TECHNICAL FIELD

The present invention relates to a spring manufacturing machine.

BACKGROUND ART

Conventionally, the following structure has been known as a spring manufacturing machine.

A first conventional spring manufacturing machine has a front wall of a machine casing which has a through hole provided in the longitudinal direction, a wire rod processing space which is formed in front of the through hole, at least two tool mounting slides which are provided in the front wall so as to freely move close to and apart from the wire rod processing space, and a wire rod feeding unit which is provided in the machine casing in the rear side of the front wall, wherein the wire rod feeding unit has a casing, a final wire rod guide which is provided in the casing so as to oppose to the through hole and has a wire rod passage guiding the wire rod discharged to the front from the rear toward the wire rod processing space, and at least a pair of wire rod feeding rollers which are rotatably provided in the casing and discharges the wire rod toward the final wire rod guide while pinching the wire rod, and the wire rod feeding unit freely rotates around a center line of the wire rod passage of the final wire rod guide.

A second conventional spring manufacturing machine has a front wall of a machine, a wire rod processing space which is formed in front of the front wall, at least two tool mounting slides which are provided in the front wall so as to freely move close to and apart from the wire rod processing space, and a wire rod feeding unit which is provided in the machine casing in the left side of the front wall, wherein the wire rod feeding unit has a casing, a final wire rod guide which is provided in the casing and has a wire rod passage guiding the wire rod discharged toward the wire rod processing space, and at least a pair of wire rod feeding rollers which are rotatably provided in the casing and discharges the wire rod toward the final wire rod guide while pinching the wire rod, and the wire rod feeding unit is provided in the machine casing so as to freely oscillate in the direction parallel to a center line of the wire rod passage of the final wire rod guide.

Patent Document 1

Japanese Unexamined Patent Publication No. 2003-48030

Patent Document 2

Japanese Unexamined Patent Publication No. 2003-33839

DISCLOSURE OF THE INVENTION

Both of the conventional spring manufacturing machines mentioned above do not have an advantage of the other spring manufacturing machine, and thus have low convenience.

In order to solve the defect mentioned above, the present invention employs the following means.

(1) In accordance with a first aspect of the present invention, there is provided a spring manufacturing machine comprising a front wall of a machine casing which has a through hole provided in the longitudinal direction, a wire rod processing space which is formed in front of the through hole, at least two tool mounting slides which are provided in the front wall so as to freely move close to and apart from the wire rod processing space, and a wire rod feeding unit which is provided in the machine casing in the rear side of the front wall, wherein the wire rod feeding unit has a casing, a final wire rod guide which is provided in the casing so as to oppose to the through hole and has a wire rod passage guiding the wire rod discharged to the front from the rear toward the wire rod processing space, and at least a pair of wire rod feeding rollers which are rotatably provided in the casing and discharges the wire rod toward the final wire rod guide while pinching the wire rod, and the wire rod feeding unit freely moves forward and backward and freely rotates around a center line of the wire rod passage of the final wire rod guide.

(2) In accordance with a second aspect of the present invention, there is provided a spring manufacturing machine as recited in the first aspect, wherein an actuating apparatus moving the wire rod feeding unit forward and backward has an oscillating arm which is provided in the machine casing such that a free end thereof freely oscillates forward and backward, a projection which is provided in the free end of the oscillating arm and opposes to the center line of the wire rod passage of the final wire rod guide, and an annular body to which the projection is fitted, and which has an annular groove having its center on the center line of the wire rod passage of the final wire rod guide in an outer peripheral portion, and is directly or indirectly provided in the casing.

(3) In accordance with a third aspect of the present invention, there is provided a spring manufacturing machine as recited in the first or second aspect, wherein the final wire rod guide freely rotates around the center line of the wire rod passage of the final wire rod guide separately and independently from the casing of the wire rod feeding unit.

The present invention can achieve the following effect on the basis of the structure mentioned above.

(1) In accordance with the invention of the first aspect, since it is possible to rotate the wire rod around the center line thereof, and it is possible to move the position of the wire rod forward and backward with respect to the tool, it is possible to improve a spring processing performance of the spring manufacturing machine.

(2) In accordance with the invention of the second aspect, it is possible to make the actuating apparatus for moving the wire rod feeding unit forward and backward to be a simple structure.

DESCRIPTION OF REFERENCE NUMERALS

Figure 1:
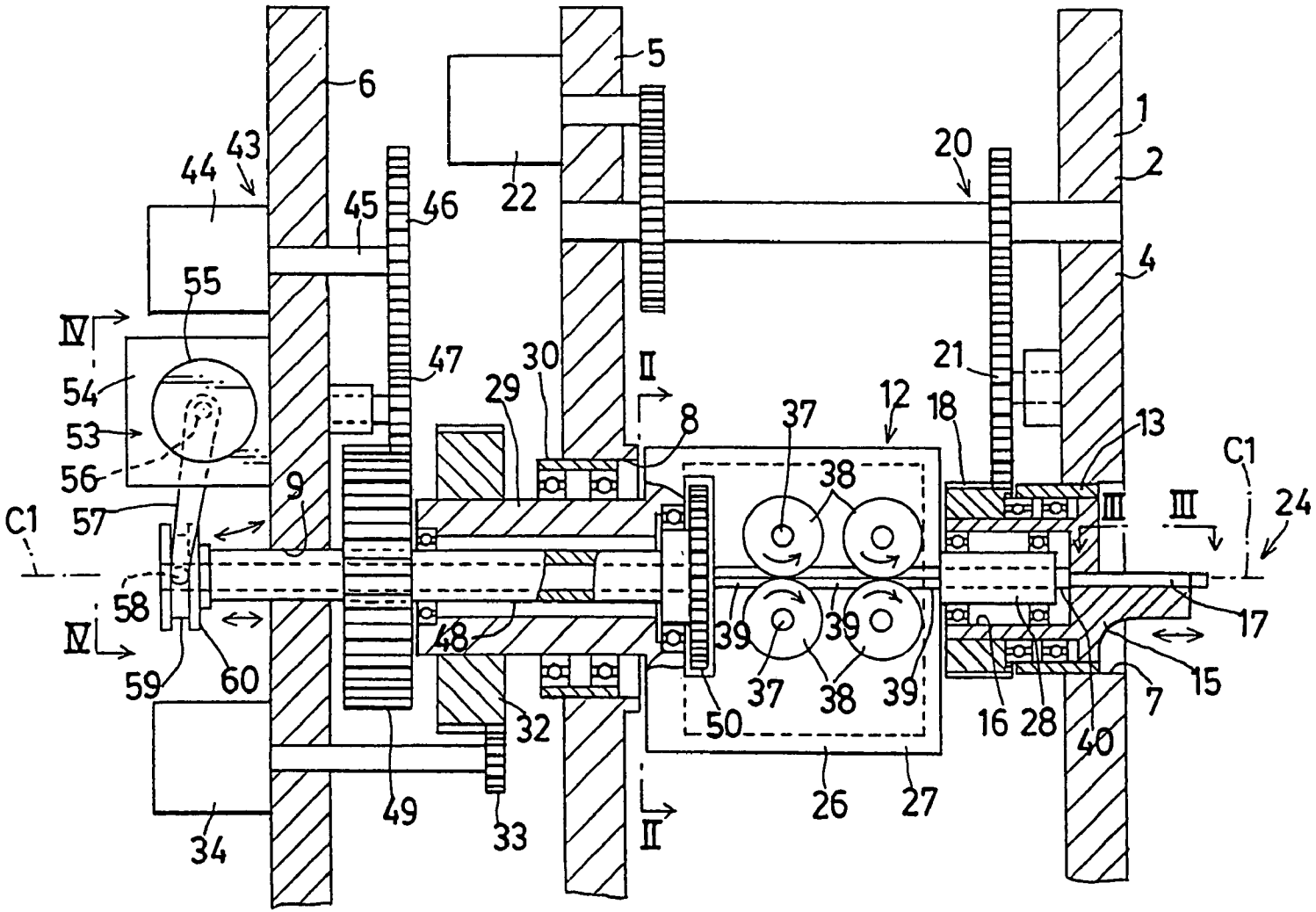
FIG. 1 is a cross sectional view of a main portion showing an embodiment in accordance with the present invention.
Figure 2:
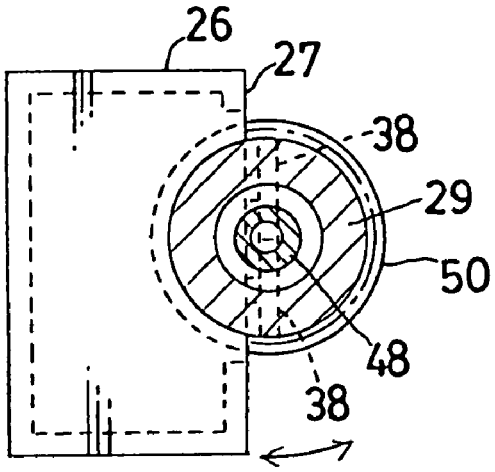
FIG. 2 is a cross sectional view along a line II—II in FIG. 1.
Figure 3:
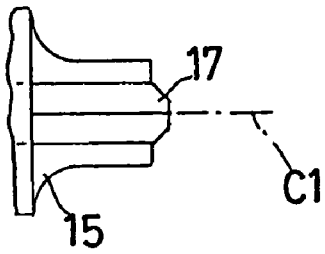
FIG. 3 is a cross sectional view as seen from a direction of arrows III—III in FIG. 1.
Figure 4:
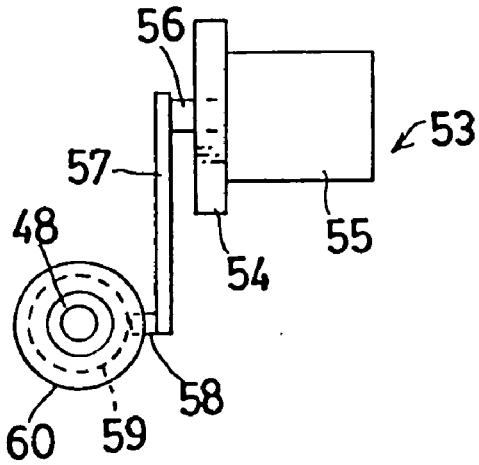
FIG. 4 is a cross sectional view as seen from a direction of arrows IV—IV in FIG. 1.

1 spring manufacturing machine
2 machine casing
4 front wall
7 circular hole (through hole)
12 wire rod feeding unit
17 final wire rod guide
24 wire rod processing space
26 rotating casing

27 casing main body
38 wire rod feeding roller
53 actuating apparatus
54 bracket
55 motor
56 rotation shaft
57 oscillating arm
58 projection
59 annular groove
60 annular body

BEST MODE FOR CARRYING OUT THE INVENTION

A description will be given below of an embodiment in accordance with the present invention.

In this case, in the description, front means the right side in FIG. 1, rear means the left side thereof, left means the top side of the paper surface in FIG. 1 and right means the back side thereof.

A machine casing 2 of a spring manufacturing machine 1 has a vertical front wall 4, a vertical intermediate wall 5 which is positioned in the rear side of the front wall 4 at a predetermined interval, and a rear wall 6 which is positioned in the rear side of the intermediate wall 5 at a predetermined interval. Circular holes 7, 8 and 9 which have a common horizontal axis are provided in the longitudinal direction in the front wall 4, the intermediate wall 5 and the rear wall 6 respectively. The center line of the circular holes 7, 8 and 9 forms a common center line C1 of a wire rod passage of a final wire rod guide 17 or the like mentioned below. In this case, the circular hole 7 corresponds to a through hole formed in the front wall 4, which will be described in claims.

A wire rod feeding unit 12 is provided in the front wall 4 and the intermediate wall 5 so as to freely move forward and backward and freely rotate around the common center line C1 of the wire rod passage of the final wire rod guide 17 or the like mentioned below, in such a manner as described in detail below.

A front longitudinally moving tube 13 corresponding to one of constituting members of the wire rod feeding unit 12 is fitted to the circular hole 7 of the front wall 4 so as to freely move forward and backward. A rotating body 15 having a recess portion 16 which is open to a rear side and has a circular cross sectional shape is rotatably fitted to the longitudinally moving tube 13, and the final wire rod guide 17 is mounted to a protruding portion in a front surface of the rotating body 15. The final wire rod guide 17 has a wire rod passage (not shown) in which the center line thereof is aligned with the common center line C1.

An annular driven gear 18 is mounted to a rear end portion of the rotating body 15, and a final gear 21 of a power transmitting mechanism 20 is engaged with the driven gear 18. The driven gear 18 is formed thick, and is structured such as to keep an engagement state with the final gear 21 at whatever position within a moving range the longitudinally moving wire rod feeding unit 12 exists.

The power transmitting mechanism 20 is structured such as to transmit rotation of a reversible rotation shaft of a motor 22 provided in the intermediate wall 5 to the driven gear 18 via the final gear 21. In accordance with the structure mentioned above, it is possible to rotate the final wire rod guide 17 around the common center line C1.

In front of the front end of the final wire rod guide 17, there is a wire rod processing space 24.

At least two tool mounting slides 100 are provided in the front surface of the front wall 4 so as to freely move close to and apart from the final wire rod guide 17.

A rotating casing 26 of the wire rod feeding unit 12 is provided in the front wall 4 and the intermediate wall 5 so as to freely rotate around the common center line C1 by a means which is described in detail below.

The rotating casing 26 has a casing main body 27, a front tube body 28 which is provided in a front portion of the casing main body 27, and a rear tube body 29 which is provided in a rear portion of the casing main body 27 and has a wire rod passing opening. Further, the front tube body 28 is rotatably fitted to the recess portion 16 of the rotating body 15, and the rear tube body 29 is rotatably fitted to a longitudinally moving tube 30 which is fitted to the circular hole 8 of the intermediate wall 5 so as to freely move forward and backward.

An annular driven gear 32 is mounted to a rear end portion of the rear tube body 29, and a driver gear 33 is engaged with the driven gear 32. The driven gear 32 is formed thick, and is structured such as to keep an engagement state with the driver gear 33 at whatever position within a moving range the longitudinally moving wire rod feeding unit 12 exists. The driver gear 33 is rotated by a reversible motor 34 provided in the rear wall 6. In accordance with the structure mentioned above, it is possible to rotate the rotating casing 26 around the common center line C1.

While the rotating casing 26 rotates in the manner mentioned above, a description will be given below of the rotating casing 26 in a state shown in FIG. 1. A pair of upper and lower roller shafts 37 in which the axes thereof are directed to the lateral direction are rotatably provided in front and rear portions of the casing main body 27, and a wire rod feeding roller 38 having an annular wire rod groove (not shown) on an outer peripheral surface is mounted to the left end protruding from the casing main body 27 in each of the roller shafts 37. A pair of the upper and lower wire rod feeding rollers 38 are brought into contact with each other, and a wire rod passage in which the center line thereof is aligned with the common center line C1 is formed by the opposing upper and lower wire rod grooves (not shown). In accordance with the structure, it is possible to discharge the wire rod (not shown) fitted into the wire rod groove to the front side by rotating the lower wire rod feeding roller 38 in the clockwise direction in FIG. 1 and rotating the upper wire rod feeding roller 38 in the counterclockwise direction in FIG. 1 synchronously with the lower wire rod feeding roller 38.

An auxiliary wire rod guide 39 having a wire rod passage (not shown) in which the center line thereof is aligned with the common center line C1 is mounted to the casing main body 27.

An auxiliary wire rod guide 40 is mounted to the front tube body 28. The front end of the auxiliary wire rod guide 40 is connected to the final wire rod guide 17, and the rear end thereof is connected to the headmost auxiliary wire rod guide 39. The center line of a wire rod passage (not shown) of the auxiliary wire rod guide 40 is aligned with the common center line C1.

The wire rod feeding roller 38 is rotated by a roller drive apparatus 43 which is described in detail below. The roller drive apparatus 43 has a motor 44 which is provided in the rear wall 6 and has a reversible rotation shaft 45, a gear 46 which is fitted to the rotation shaft 45, and a gear 47 which is engaged with the gear 46. Further, the roller drive apparatus 43 is rotatably fitted to the rear tube body 29 of the rotating casing 26, and has a hollow shaft 48 which protrudes to a rear portion through the circular hole 9 of the rear wall 6, an annular driven gear 49 which is provided in a portion exposed from the rotating casing 26 in the hollow shaft 48, an annular gear 50 which is provided in an end portion positioned inside the rotating casing 26 in the hollow shaft 48, and a plurality of transmission gears (not shown) (provided within the casing main body 27) which transmits a rotation of the gear 50 to the roller shafts 37 of the wire rod feeding rollers 38.

A window for exposing the annular gear 50 to the outside of the casing main body 27 is formed in the casing main body 27.

The driven gear 49 is engaged with the gear 47. In accordance with the structure mentioned above, it is possible to rotate the hollow shaft 48 around the common center line C1 so as to rotate the wire rod feeding rollers 38 in the manner mentioned above. The driven gear 49 is made thick, and is structured such as to keep the engagement state with the gear 47 at whatever position within the moving range the longitudinally moving wire rod feeding unit 12 exists.

The wire rod feeding unit 12 is structured such as to be moved forward and backward by an actuating apparatus 53 which is described in detail below.

The actuating apparatus 53 is constituted by a motor 55 which is fixed to the rear wall 6 via a bracket 54 and has a reversible rotation shaft 56 with an axis directed in the lateral direction, an oscillating arm 57 which is oscillated forward and backward by the motor 55, a projection 58 which is provided in a free end of the oscillating arm 57 and opposes to the center line C1 of the wire rod passage of the final wire rod guide 17, and an annular body 60 which has an annular groove 59 fitted to the projection 58 and is fitted to the hollow shaft 48 (is indirectly provided in the rotating casing 26).

A description will be additionally given of modified embodiments and the like.

(1) The wire rod feeding rollers 38 may be constituted by at least one pair of wire rod feeding rollers.

(2) The annular body 60 may be directly mounted to the rotating casing 26.

INDUSTRIAL APPLICABILITY

The present invention can be utilized for processing a wire rod for various wire rod products.

What is claimed is:

1. A spring manufacturing machine, comprising:

a machine casing having a front wall, the front wall having a through hole, a wire rod processing space being defined in front of the through hole for accommodating at least two tool mounting slides;

a wire rod feeding unit provided in the machine casing and at a rear side of the front wall, said wire rod feeding unit having a casing, a final wire rod guide provided in the casing in alignment with the through hole and having a wire rod passage for guiding a wire rod discharged to a front from a rear and toward the wire rod processing space, and at least a pair of wire rod feeding rollers which are rotatably provided in the casing and which discharges the wire rod toward the final wire rod guide while pinching the wire rod, said wire rod feeding unit being freely movable forward and backward and freely rotatable around a center line of the wire rod passage of the final wire rod guide; and an actuating apparatus for moving said wire rod feeding unit forward and backward, and having a motor having a reversible rotatable shaft;

an oscillating arm having a fixed end attached to the rotatable shaft of the motor, and a free end that oscillates forward and backward when the rotatable shaft is moved, a projection provided at the free end of the oscillating arm and disposed along the center line of the wire rod passage of the final wire rod guide, and an annular body connected to said wire rod feeding unit and having an annular groove that receives the projection, the annular groove being concentric to the center line of the wire rod passage of the final wire rod guide.

2. A spring manufacturing machine as claimed in claim 1, wherein said final wire rod guide freely rotates around the center line of the wire rod passage of the final wire rod guide separately and independently from the casing of the wire rod feeding unit.

* * * * *